US008821607B2

(12) United States Patent
Moriya et al.

(10) Patent No.: US 8,821,607 B2
(45) Date of Patent: Sep. 2, 2014

(54) PARTICLE CAPTURE UNIT, METHOD FOR MANUFACTURING THE SAME, AND SUBSTRATE PROCESSING APPARATUS

(75) Inventors: Tsuyoshi Moriya, Tokyo (JP); Syunsuke Toyoizumi, Fuchu (JP); Katsuyuki Takahiro, Fuchu (JP)

(73) Assignee: Tokyo Electron Limited, Tokyo (JP)

( * ) Notice: Subject to any disclaimer, the term of this patent is extended or adjusted under 35 U.S.C. 154(b) by 76 days.

(21) Appl. No.: 13/428,614

(22) Filed: Mar. 23, 2012

(65) Prior Publication Data

US 2012/0240533 A1 Sep. 27, 2012

(30) Foreign Application Priority Data

Mar. 25, 2011 (JP) ..... 2011-068473

(51) Int. Cl.
*B01D 46/00* (2006.01)
*F04B 37/08* (2006.01)

(52) U.S. Cl.
CPC ..... *F04B 37/08* (2013.01); *Y10S 55/05* (2013.01); *Y10S 29/902* (2013.01); *Y10S 264/48* (2013.01)
USPC ..... 55/385.1; 55/385.2; 55/467; 55/471; 55/485; 55/486; 55/487; 55/488; 55/523; 55/DIG. 5; 29/889; 29/902; 264/628; 264/DIG. 48

(58) Field of Classification Search
USPC ..... 55/527, 385.3, 522, DIG. 5, 525, 526, 55/DIG. 43; 264/DIG. 48, 103, 294, 320; 123/198 E; 210/500.25; 428/608, 613; 442/117, 376, 377, 378, 379; 280/742, 280/736; 29/896.62, 902
See application file for complete search history.

(56) References Cited

U.S. PATENT DOCUMENTS

| | | | | |
|---|---|---|---|---|
| 3,339,347 | A * | 9/1967 | Otto, Jr. | 55/290 |
| 4,071,455 | A * | 1/1978 | Haver | 210/497.1 |
| 4,181,514 | A * | 1/1980 | Lefkowitz et al. | 55/488 |
| 5,266,279 | A * | 11/1993 | Haerle | 422/177 |
| 5,809,777 | A * | 9/1998 | Kawamura | 60/303 |
| 6,096,117 | A | 8/2000 | Lisson et al. | |
| 6,387,141 | B1 * | 5/2002 | Hollingsworth et al. | 55/486 |
| 6,585,794 | B2 * | 7/2003 | Shimoda et al. | 55/527 |
| 6,849,206 | B2 * | 2/2005 | Matsuo | 252/514 |
| 6,926,828 | B2 * | 8/2005 | Shiraishi et al. | 210/310 |
| 7,398,887 | B2 * | 7/2008 | Choi | 210/491 |
| 7,435,280 | B2 * | 10/2008 | Greenwood | 55/526 |
| 7,559,146 | B2 * | 7/2009 | Greenwood | 29/896.62 |
| 7,837,432 | B2 | 11/2010 | Moriya et al. | |
| 2008/0240905 | A1 | 10/2008 | Sugawara et al. | |

FOREIGN PATENT DOCUMENTS

| | | | |
|---|---|---|---|
| JP | 2007-180467 | | 7/2007 |
| JP | 2008-240701 | A | 10/2008 |
| KR | 10-2008-0106333 | A | 12/2008 |

* cited by examiner

*Primary Examiner* — Duane Smith
*Assistant Examiner* — Minh-Chau Pham
(74) *Attorney, Agent, or Firm* — Rothwell, Figg, Ernst & Manbeck, P.C.

(57) ABSTRACT

A particle capture unit adopted to be exposed to a space in which particles fly includes at least a first layer formed of a plurality of first fiber-like materials and a second layer formed of a plurality of second fiber-like materials. The first fiber-like materials are thinner than the second fiber-like materials and arrangement density of the first fiber-like materials in the first layer is higher than that of the second fiber-like materials in the second layer, the second layer is interposed between the first layer and the space, and the first and second layers are hardened and bonded together by sintering.

17 Claims, 6 Drawing Sheets

PARTICLE CAPTURE UNIT, METHOD FOR MANUFACTURING THE SAME, AND SUBSTRATE PROCESSING APPARATUS

FIELD OF THE INVENTION

The present invention relates to a particle capture unit which is capable of capturing unnecessary particles moving within a substrate processing apparatus, a method for manufacturing the same, and a substrate processing apparatus.

BACKGROUND OF THE INVENTION

Typically, a substrate processing apparatus for processing a wafer for a semiconductor device or a substrate such as a glass substrate or the like used to manufacture a FPD (Flat Panel Display) panel such as a LCD (Liquid Crystal Display) panel, a solar cell and the like includes a processing chamber (hereinafter referred to as a "chamber") in which a substrate to be processed is provided. Deposits on a chamber inner wall or particles resulting from reaction products generated in a specific process are floating in the chamber. When these floating particles are adhered to a surface of a wafer, a wiring circuit short may occur in a product made from the wafer, such as a semiconductor device, which may result in deterioration of yield of semiconductor devices. To overcome this problem, the particles in the chamber are removed from the chamber while exhausting gas in the chamber by means of an exhaust system of the substrate processing apparatus.

The exhaust system of the substrate processing apparatus includes an exhaust chamber (manifold) communicating with the processing chamber via an exhaust plate, a TMP (Turbo Molecular Pump) which is a high vacuum exhaust pump, and a communication pipe communicating the TMP with the manifold. The TMP includes a shaft disposed along a flow of an exhaust gas and a plurality of rotational blades protruding at a right angle from the shaft and exhausts an intaken gas as the rotational blades rotate around the shaft at a high speed. The exhaust system discharges the particles in the processing chamber along with the gas in the processing chamber by operating the TMP.

However, in some cases, deposits adhered to the rotational blades of the TMP may be peeled off or particles included in the gas intaken by the TMP or residues introduced from the manifold into the TMP via the communication pipe may be bounced by collision with the rotational blades of the TMP. The deposits peeled out of the rotational blades and the particles being bounced by the collision with the rotational blades have high kinetic energy due to the high speed rotation of the rotational blades, thereby allowing the deposits and the particles to be flown backward through the communication pipe into the chamber.

To cope with the above-mentioned backflow of particles, the present inventors have suggested a reflecting device for reflecting particles being bounced from a TMP toward the TMP and a capture mechanism for capturing the particles (e.g., see Japanese Patent Application Publication No. 2007-180467 (JP2007-180467A)). The reflecting device and the capture mechanism disclosed in JP2007-180467A can reflect most of the bounced particles back to the TMP or capture them.

However, the reflecting device disclosed in JP2007-180467A deteriorates exhaust efficiency by decreasing a conductance of an exhaust passage since the reflecting device is arranged to interrupt an exhaust pipe. In addition, although the capture mechanism disclosed in JP2007-180467A is arranged along the inner side of the exhaust pipe, it requires a predetermined thickness to capture particles introduced into the capture mechanism since the introduced particles lose their kinetic energy through repeated collision with components of the capture mechanism. As a result, the capture mechanism is protruded into the exhaust pipe, thereby deteriorating the exhaust efficiency by decreasing the conductance of the exhaust passage. The deterioration of the exhaust efficiency results in increased time taken for vacuum exhaustion of a chamber and low operability of a substrate processing apparatus.

In addition, although JP2007-180467A discloses the capture mechanism formed of a cotton-like material composed of fibers, these fibers are likely to disintegrate from the cotton-like material. In addition, if some of the disintegrated fibers are dropped on the TMP, rotational blades of the TMP are likely to be damaged.

SUMMARY OF THE INVENTION

The present invention provides a particle capture unit which is capable of preventing deterioration of exhaust efficiency and damage of rotational blades and or the like of an exhaust pump, a method for manufacturing the same, and a substrate processing apparatus.

In accordance with an aspect of the present invention, there is provided a particle capture unit adopted to be exposed to a space in which particles fly including: at least a first layer formed of a plurality of first fiber-like materials; and a second layer formed of a plurality of second fiber-like materials.

The first fiber-like materials are thinner than the second fiber-like materials and arrangement density of the first fiber-like materials in the first layer is higher than that of the second fiber-like materials in the second layer. The second layer is interposed between the first layer and the space, and the first and second layers are hardened and bonded together by sintering.

In accordance with another aspect of the present invention, there is provided a method for manufacturing a particle capture unit adopted to be exposed to a space in which particles fly.

The method includes: forming a first layer formed of a plurality of first fiber-like materials and a second layer formed of a plurality of second fiber-like materials; overlapping the first layer and the second layer and shaping the overlapped first and second layers into a desired shape such that the second layer is interposed between the first layer and the space; and hardening and bonding the first and second layers together by sintering.

The first fiber-like materials are thinner than the second fiber-like materials and arrangement density of the first fiber-like materials in the first layer is higher than that of the second fiber-like materials in the second layer.

In accordance with still another aspect of the present invention, there is provided a substrate processing apparatus including: a processing chamber in which a substrate is subjected to a predetermined process; an exhaust pump having a rotational blade that is rotatable at a high speed, the exhaust pump serving to exhaust a gas in the processing chamber; and an exhaust system which allows the processing chamber to communicate with the exhaust pump.

The substrate processing apparatus includes a particle capture unit exposed to a space in which particles fly. The particle capture unit includes at least a first layer formed of a plurality of first fiber-like materials and a second layer formed of a plurality of second fiber-like materials. The first fiber-like materials are thinner than the second fiber-like materials and arrangement density of the first fiber-like materials in the first layer is higher than that of the second fiber-like materials in the second layer. The second layer is interposed between the first layer and the space, and the first and second layers are hardened and bonded together by sintering.

BRIEF DESCRIPTION OF THE DRAWINGS

The objects and features of the present invention will become apparent from the following description of embodiments, given in conjunction with the accompanying drawings, in which.

DETAILED DESCRIPTION OF THE EMBODIMENTS

Hereinafter, embodiments of the present invention will be described with reference to the drawings which form a part hereof.

Figure 1:
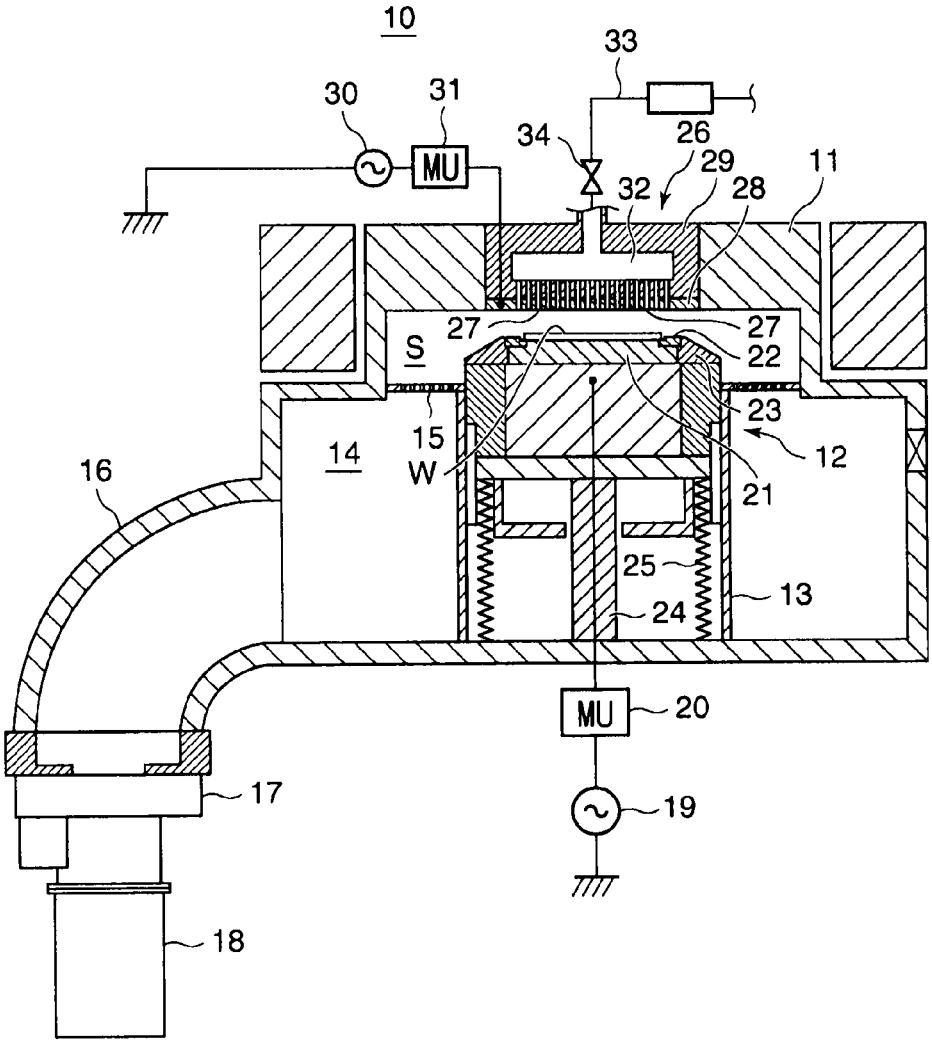
FIG. 1 is a schematic sectional view showing a configuration of a substrate processing apparatus to which a particle capture unit is applied in accordance with an embodiment of the present invention.

FIG. 1 is a schematic sectional view showing a configuration of a substrate processing apparatus to which a particle capture unit is applied, in accordance with the embodiment of the present invention.

As shown in FIG. 1, a substrate processing apparatus 10 that is constructed as an etching processing apparatus for subjecting a semiconductor wafer (hereinafter referring to as a "wafer") to reactive ion etching (RIE), includes a chamber 11 (processing chamber) which is made of, e.g., aluminum or stainless steel and has a shape with a smaller and a larger cylinders stacked on each other.

In the chamber 11, a lower electrode 12 as a wafer stage which mounts the wafer and elevates within the chamber 11 with the mounted wafer W and a cylindrical cover 13 covering a side of the elevating lower electrode 12 are disposed.

An annular exhaust plate 15 partitioning an exhaust chamber (hereinafter referred to as a "manifold") 14 from a processing space S, which is formed above the lower electrode 12, is disposed at the side of the lower electrode 12. The manifold 14 communicates with a TMP (Turbo Molecular Pump) 18, which is an exhausting pump for vacuum evacuation, via a communication pipe 16 and an automatic pressure control (APC) valve 17, which is a variable slide valve. The TMP 18 depressurizes the chamber 11 to be substantially vacuum state and the APC valve 17 controls the pressure in the chamber 11 when the chamber 11 is depressurized. The exhaust plate 15 has a plurality of slit-like or circular vent holes, which allow the processing space S and the manifold 14 to communicate with each other. In the substrate processing apparatus 10, the manifold 14, the communication pipe 16 and the APC valve 17 constitute an exhaust system.

A lower high frequency power supply 19 is connected to the lower electrode 12 via a lower matching unit (MU) 20. The lower high frequency power supply 19 applies a predetermined high-frequency power to the lower electrode 12. The lower matching unit 20 reduces reflection of the high-frequency power from the lower electrode 12 so as to maximize the supply efficiency of the high-frequency power to the lower electrode 12.

An electrostatic chuck (ESC) 21 for attracting the wafer W with an electrostatic absorptive force is disposed at an upper part of the lower electrode 12. An electrode plate (not shown) built-in the ESC 21 is electrically connected to a DC power supply (not shown). The ESC 21 adsorptively holds the wafer W on its top surface through a Coulomb force or a Johnsen-Rahbek force which is generated by a DC voltage applied from the DC power supply to the electrode plate. An annular focus ring 22 made of silicon (Si) or the like is disposed at a peripheral of the ESC 21 and the periphery of the focus ring 22 is covered with an annular cover ring 23.

A support 24 extending downward from the lower part of the lower electrode 12 is disposed below the lower electrode 12. The support 24 supports and elevates the lower electrode 12. The periphery of the support 24 is covered with a bellows 25 to isolate the support 24 from atmospheres of the chamber 11 and the manifold 14.

In the substrate processing apparatus 10, the lower electrode 12 is descended to a loading/unloading position of the wafer when the wafer W is loaded into or unloaded from the chamber 11, and the lower electrode 12 is ascended to a processing position of the wafer W when the wafer W is subjected to RIE processing.

A shower head 26 for supplying a processing gas, which will be described later, into the chamber 11 is disposed on a ceiling of the chamber 11. The shower head 26 includes a disk-shaped upper electrode 28 having a plurality of gas vent holes 27 facing the processing space S, and an electrode support 29 which is disposed on the upper electrode 28 and detachably supports the upper electrode 28.

An upper high frequency power supply 30 is connected to the upper electrode 28 via an upper matching unit (MU) 31. The upper high frequency power supply 30 applies a predetermined high-frequency power to the upper electrode 28. The upper matching unit 31 reduces reflection of the high-frequency power from the upper electrode 28 so as to maximize the supply efficiency of the high-frequency power to the upper electrode 28.

A buffer space 32 is provided inside the electrode support 29, a processing gas inlet pipe 33 is connected to the buffer space 32, and a valve 34 is placed in the course of the processing gas inlet pipe 33. A processing gas such as, e.g., carbon tetrafluoride ($CF_4$), a mixture of $CF_4$, argon gas (Ar), oxygen gas ($O_2$) and silicon tetrafluoride ($SiF_4$), or the like is introduced from the processing gas inlet pipe 33 into the buffer space 32 and the introduced processing gas is supplied into the processing space S via the gas vent holes 27.

In the chamber 11 of the substrate processing apparatus 10, the high-frequency powers are applied to the lower and upper electrodes 12 and 28, as described above, and a high density plasma is generated from the processing gas in the processing space S by the applied high-frequency powers, thereby producing ions and radicals. These produced ions and radicals are used to physically or chemically etch a surface of the wafer W adsorptively held on the top surface of the lower electrode 12.

Figure 2:
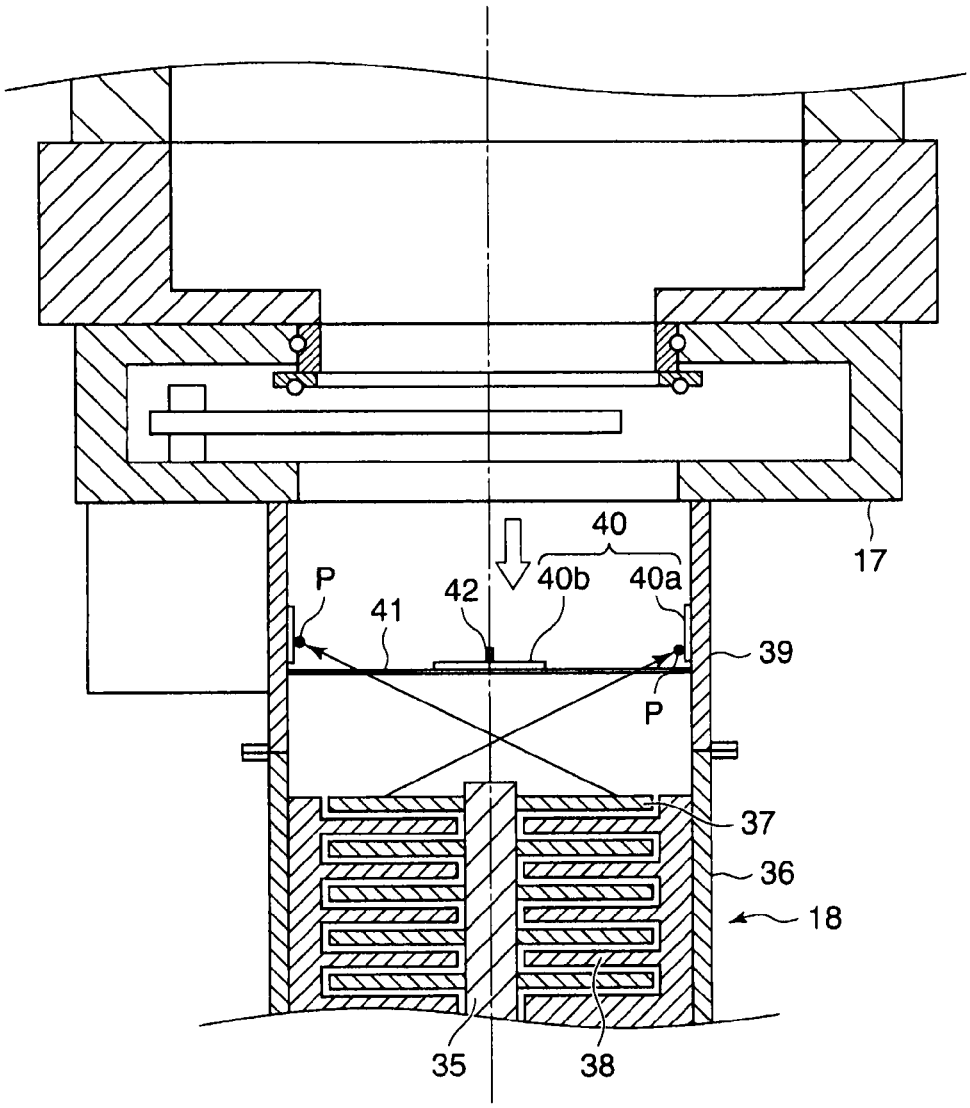
FIG. 2 is an enlarged sectional view of an APC valve and a TMP in the substrate processing apparatus in FIG. 1.
Figure 3:
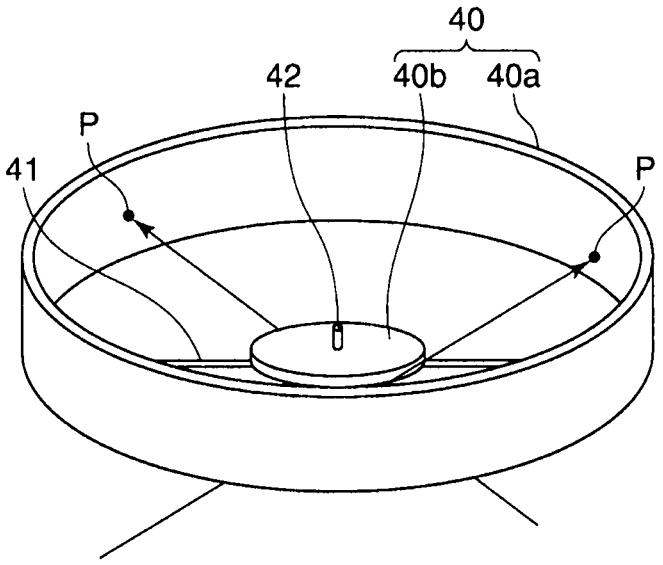
FIG. 3 is a schematic perspective view showing a configuration of a particle capture unit in accordance with the embodiment of the present invention.

FIG. 2 is an enlarged sectional view of the APC valve 17 and the TMP 18 in the substrate processing apparatus 10 of FIG. 1, and FIG. 3 is a schematic perspective view showing a configuration of a particle capture unit in accordance with the embodiment of the present invention.

As shown in FIG. 2, the TMP 18 includes a rotational shaft 35 disposed in a vertical direction, i.e., along a flow of an exhaust gas, a cylindrical body 36 which is disposed in parallel with the rotational shaft 35 for accommodating the rotational shaft 35, a plurality of rotational blades 37 protruding from the rotational shaft 35 at a right angle, and a plurality of stationary blades 38 protruding from the inner surface of the cylindrical body 36 toward the rotational shaft 35.

The rotational blades 37 protrudes radially from the rotational shaft 35 to form a group of rotational blades and the stationary blades 38 is disposed with an equal interval on the same circumference of the inner peripheral surface of the cylindrical body 36 and protrudes toward the rotational shaft 35 to form a group of stationary blades. The TMP 18 has a plurality of groups of rotational blades which is disposed with an equal interval along the rotational shaft 35 and a plurality of groups of stationary blades, each of which is interposed between two adjacent groups of rotational blades.

In general, in the TMP 18, the uppermost group of rotational blades is disposed above the uppermost group of stationary blades in the figure. That is, the uppermost group of rotational blades is disposed nearer to the communication pipe 16 than the uppermost group of stationary blades. The TMP 18 exhausts a gas from the communication pipe 16 to the lower side of the TMP 18 at a high speed by rotating the rotational blades 37 around the rotational shaft 35 at a high speed.

A relatively short cylindrical exhaust pipe 39 is provided between the APC valve 17 and the TMP 18. The exhaust pipe 39 communicates the APC valve 17 with the TMP 18 and includes a particle capture unit 40 therein.

In FIGS. 2 and 3, the particle capture unit 40 includes a cylindrical first capture unit 40*a* (cylindrical part) disposed along the inner peripheral surface of the exhaust pipe 39, and a disk-shaped second capture unit 40*b* (plate-shaped part) disposed on an axis of the rotational shaft 35 of the TMP 18 to cover the rotational shaft 35 when viewed from top (i.e., when viewed along a white arrow in FIG. 2). The second capture unit 40*b* is attached to a bar-shaped stay 41 disposed to traverse the exhaust pipe 39 by means of a cap screw 42. Each of the first capture unit 40*a* and the second capture unit 40*b* is formed of a three-layered mesh-like member 43 (which will be described later) and captures introduced particles P.

In detail, when particles P introduced into the TMP 18 collide with the rotational blades 37 rotating at a high speed, the particles P are bounced toward the inner peripheral surface of the exhaust pipe 39 due to their tangential kinetic energy of the rotation of the rotational blades 37. However, since the first capture unit 40*a* is disposed along the inner peripheral surface of the exhaust pipe 39, the bounced particles P reach the first capture unit 40*a* which then captures the particles P.

In addition, particles (not shown) introduced toward the rotational shaft 35 of the TMP 18 are adhered to peripheries of the TMP 18 to become deposits which may cause particles flowing backward from the TMP 18 toward the exhaust pipe 39 and or the like. However, since the second capture unit 40*b* is disposed in the exhaust pipe 39 at an up stream side of the TMP 18 in an exhaust direction, the second capture unit 40*b* captures the particles introduced toward the rotational shaft 35 of the TMP 18.

Although the second capture unit 40*b* is fixed to the stay 41 by means of the cap screw 42 in the present embodiment, the means for fixing the second capture unit 40*b* to the stay 41 is not limited thereto but may be other fixable means such as an adhesive or the like. In addition, although the stay 41 is bar-shaped, the stay 41 is not limited thereto but may have any shape such as a mesh shape or the like as long as it can hold the second capture unit 40*b* in a space.

Figure 4:
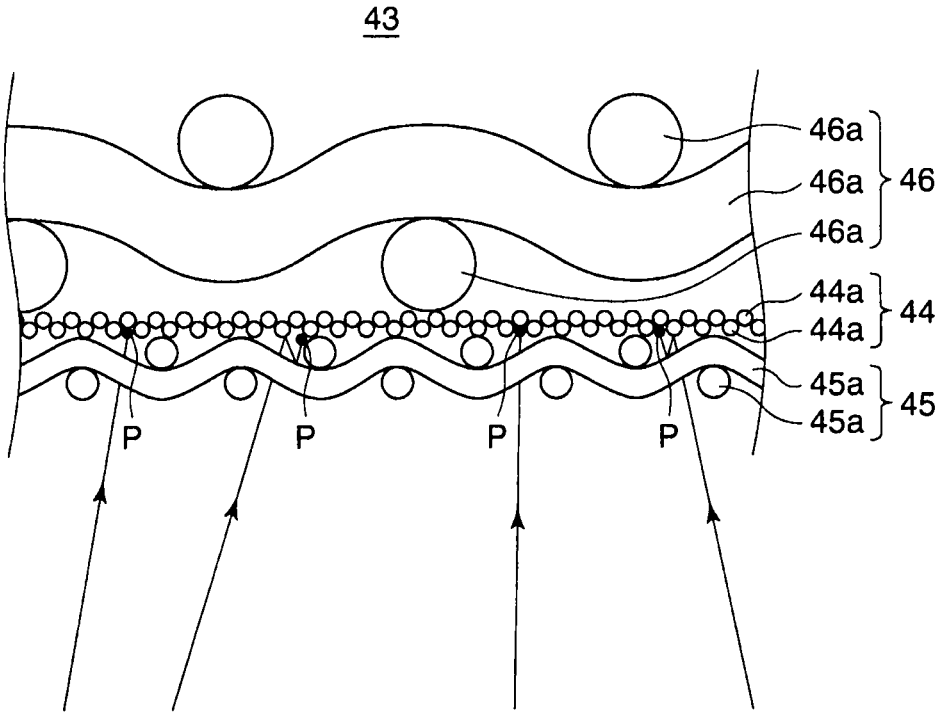
FIG. 4 is a schematic enlarged sectional view showing a structure of a mesh-like member forming a first capture unit and a second capture unit in FIG. 3.

FIG. 4 is a schematic enlarged sectional view showing a structure of the mesh-like member forming the first capture unit 40*a* and the second capture unit 40*b* in FIG. 3.

As shown in FIG. 4, the mesh-like member 43 includes a first mesh-like layer 44 (i.e., first layer) woven from a plurality of fiber-like first stainless steels 44*a* having a diameter in a range from 0.2 μm to 3 μm, a second mesh-like layer 45 (i.e., second layer) woven from a plurality of fiber-like second stainless steels 45*a* having a diameter in a range from 3 μm to 30 μm, and a third mesh-like layer 46 (i.e., third layer) formed of a plurality of fiber-like third stainless steels 46*a* having a diameter in a range from 30 μm to 400 μm.

The first stainless steels 44*a*, the second stainless steels 45*a*, and the third stainless steels 46*a* are at least doubly overlapped in the first mesh-like layer 44, in the second mesh-like layer 45 in the third mesh-like layer 46, respectively. In this figure, the second mesh-like layer 45, the first mesh-like layer 44 and the third mesh-like layer 46 are stacked in that order from a bottom, and the total thickness of the mesh-like member 43 is limited to 1 mm or less.

In the first capture unit 40*a*, since the mesh-like member 43 is arranged to interpose the second mesh-like layer 45 between the first mesh-like layer 44 and an inner space of the exhaust pipe 39, i.e., a space into which the particles P fly (hereinafter referred to as a "particle flying space"), the second mesh-like layer 45 is exposed to the particle flying space. Since the third mesh-like layer 46 is arranged opposite to the second mesh-like layer 45 via the first mesh-like layer 44, the third mesh-like layer 46 contacts the inner peripheral surface of the exhaust pipe 39 without being exposed to the particle flying space.

In the second capture unit 40*b*, the mesh-like member 43 is arranged such that the second mesh-like layer 45 faces a flow of exhaust gas including the particles P flowing through the exhaust pipe 39, and thus, the second mesh-like layer 45 is exposed to the flow of exhaust gas. Since the third mesh-like layer 46 is arranged opposite the second mesh-like layer 45 via the first mesh-like layer 44, the third mesh-like layer 46 contacts the stay 41. At this time, since the second capture unit 40*b* uses the mesh-like member 43 and has a thin thickness of 1 mm or less, it is possible to prevent deterioration of exhaust conductance in the exhaust pipe 39.

In the mesh-like member 43 of each of the first and second capture units 40*a* and 40*b*, since the second mesh-like layer 45 is exposed to the particle flying space or the flow of exhaust gas, the particles P are first introduced into the second mesh-like layer 45. A few of the introduced particles P are captured by openings (gaps) of meshes constituted by the second stainless steels 45*a* in the second mesh-like layer 45, while some of the particles P reach the first mesh-like layer 44 through the second mesh-like layer 45 since the second stainless steels 45*a* in the second mesh-like layer 45 are thick and gaps formed in the second mesh-like layer 45 are large.

Since the first stainless steels 44*a* in the first mesh-like layer 44 are relatively thin, small gaps are only produced in the first mesh-like layer 44, and accordingly, the particles P reaching the first mesh-like layer 44 stay in the first mesh-like layer 44 without passing therethrough and are captured by openings (gaps) of meshes formed by the first stainless steels 44*a* in the first mesh-like layer 44.

A few of the particles P reaching the first mesh-like layer 44 try to return to the particle flying space after being reflected by the first stainless steels 44*a* without being captured by the gaps of the first mesh-like layer 44. However, since the second mesh-like layer 45 is interposed between the first mesh-like layer 44 and the particle flying space, the reflected particles P are captured by the second mesh-like layer 45 or bounced again to the first mesh-like layer 44 with their kinetic energy reduced by collision with the second stainless steels 45*a* of the second mesh-like layer 45. After reaching the first mesh-like layer 44, the bounced particles P having the kinetic energy reduced stay in the first mesh-like layer 44 without being reflected therefrom.

Accordingly, the particles P introduced into the mesh-like member 43 can be surely captured by the mesh-like member 43 without returning therefrom to the particle flying space.

In addition, since the third stainless steels 46*a* forming the third mesh-like layer 46 are thicker than the first stainless steels 44*a* forming the first mesh-like layer 44 and the second stainless steels 45*a* forming the second mesh-like layer 45 and the third mesh-like layer 46 forms a part of the mesh-like member 43, the third mesh-like layer 46 can contribute to improvement in rigidity of the mesh-like member 43 and prevent deterioration of particle capturing efficiency owing to deformation of the first and second capture units 40*a* and 40*b*.

Next, a method for manufacturing the particle capture units in accordance with the embodiment of the present invention will be described.

Figure 5A:
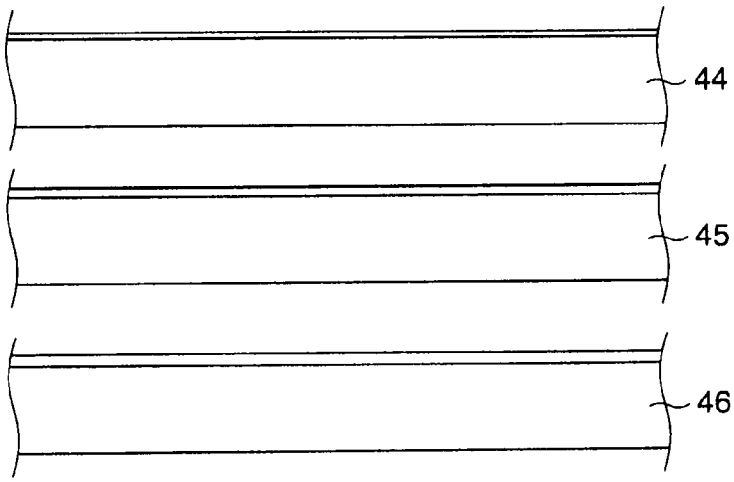
FIGS. 5A to 5C are process diagrams of a method for manufacturing the first capture unit in the particle capture unit in accordance with the embodiment of the present invention.
Figure 5B:
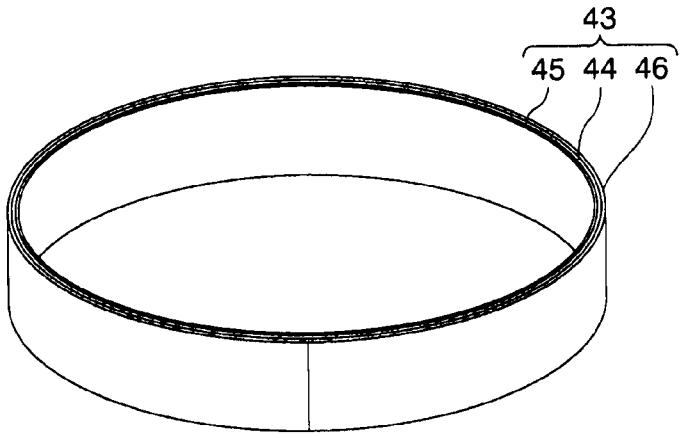
Figure 5C:
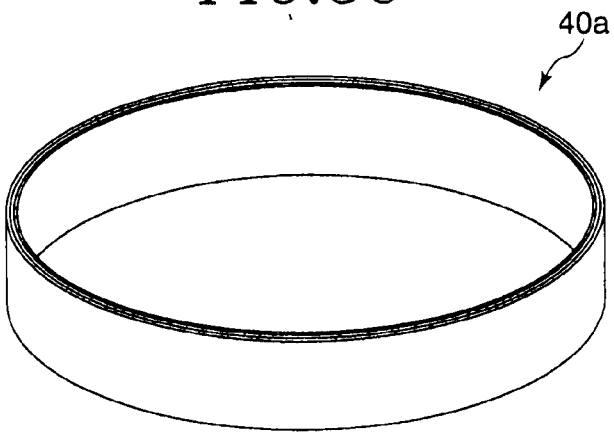

FIGS. 5A to 5C are process diagrams of a method for manufacturing the first capture unit 40*a* in the particle capture unit 40 in accordance with the present embodiment.

As shown in FIG. 5A, first, the plurality of first stainless steels 44*a*, the plurality of second stainless steels 45*a*, and the plurality of third stainless steels 46*a* are woven into the first mesh-like layer 44 of a band shape, into the second mesh-like layer 45 of a band shape and into the third mesh-like layer 46 of a band shape, respectively (Layer forming step).

Next, as shown in FIG. 5B, the band-shaped first mesh-like layer 44, the band-shaped second mesh-like layer 45 and the band-shaped third mesh-like layer 46 are cut in the almost same length, and the mesh-like member 43 is formed by placing the first mesh-like layer 44 on the third mesh-like layer 46 and placing the second mesh-like layer 45 on the first mesh-like layer 44 and is shaped into a cylindrical body. At this time, when the first capture unit 40*a* made from the mesh-like member 43 is arranged on the exhaust pipe 39, the second mesh-like layer 45 is located in the innermost peripheral side of the cylindrical body in such a manner that the second mesh-like layer 45 is exposed to the particle flying space (Shaping step).

Next, as shown in FIG. 5C, the layers of the cylindrical mesh-like member 43 are hardened and bonded by sintering to complete the first capture unit 40*a*, and then the process is completed.

The second capture unit 40*b* is manufactured according to the manufacturing method in FIGS. 5A to 5C except that it is cut into a circular shape (not into the band shape) and is not shaped into the cylindrical body.

According to the particle capture unit 40 of the present embodiment, the mesh-like member 43 forming the first capture unit 40*a* and the second capture unit 40*b* includes the first mesh-like layer 44 composed of the plurality of first stainless steels 44*a* and the second mesh-like layer 45 composed of the plurality of second stainless steels 45*a*. Herein, the first stainless steels 44*a* are thinner than the second stainless steels 45*a*, and arrangement density of the first stainless steels 44*a* in the first mesh-like layer 44 is higher than that of the second stainless steels 45*a* in the second mesh-like layer 45. Therefore, the first mesh-like layer 44 can capture the particles P introduced into the mesh-like member 43 and passed through the second mesh-like layer 45.

In addition, since the second mesh-like layer 45 is interposed between the first mesh-like layer 44 and the particle flying space, the particles p reflected from the first mesh-like layer 44 after being passed through the second mesh-like layer 45 are bounced again to the first mesh-like layer 44 with their kinetic energy reduced by collision with the second stainless steels 45*a* of the second mesh-like layer 45. Accordingly, the particles P will not get out of the mesh-like member 43.

As a result, the particles P introduced into the mesh-like member 43 can be surely captured without making the mesh-like member 43 thick, e.g., even when the thickness of the mesh-like member 43 is set to 1 mm or less.

In addition, since the third mesh-like layer 46, the first mesh-like layer 44 and the second mesh-like layer 45 in each of the first capture unit 40*a* and the second capture unit 40*b* of the particle capture unit 40 are hardened and bonded together by sintering, the first capture unit 40*a* and the second capture unit 40*b* have high rigidity. Accordingly, since there is no need to prepare a frame for supporting the first capture unit 40*a* and the second capture unit 40*b*, the particle capture unit 40 can be prevented from being protruded into the inner space of the exhaust pipe 39. As a result, the particle capture unit can prevent deterioration of exhaust efficiency.

In addition, since the mesh-like member 43 is sintered, some of the first stainless steels 44*a* forming the first mesh-like layer 44, some of the second stainless steels 45*a* forming the second mesh-like layer 45 and some of the third stainless steels 46*a* forming the third mesh-like layer 46 will not be missed. As a result, since missed parts of the stainless steels will not be bounced by collision with the rotational blades 37 of the TMP 18, it is possible to reliably prevent foreign substances from being introduced into the processing chamber and prevent the rotational blades 37 and or the like of the TMP 18 from being damaged.

In addition, in either the first capture unit 40*a* or the second capture unit 40*b*, since the mesh-like member 43 is transformed into a desired shape and then the third mesh-like layer 46, the first mesh-like layer 44 and the second mesh-like layer 45 are hardened by sintering, the desired shape can be easily realized.

In addition, since the first mesh-like layer 44, the second mesh-like layer 45 and the third mesh-like layer 46 are made of stainless steel, they are allowed to be expanded or distorted in some degrees. Accordingly, when the mesh-like member 43 is transformed into the desired shape before sintering, some of the first mesh-like layer 44, the second mesh-like layer 45 and the third mesh-like layer 46 can be prevented from being broken out, thereby facilitating manufacture of the particle capture unit 40.

While the present invention has been shown and described by way of the above embodiments, the present invention is not limited to the disclosed embodiments.

Figure 6:
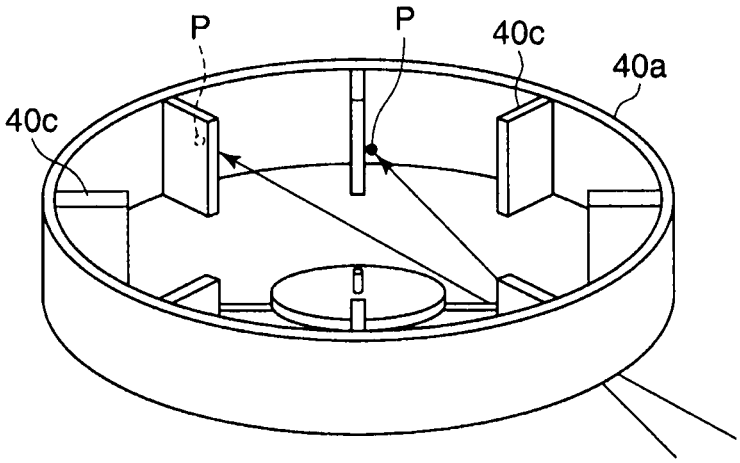
FIG. 6 is a schematic perspective view showing configuration of a modification of the particle capture unit in accordance with the embodiment of the present invention.

For example, as shown in FIG. 6, in the particle capture unit 40, the mesh-like member 43 may be provided with a plurality of plate-shaped protrusions 40*c* protruded from the first capture unit 40*a* toward the inner side of the exhaust pipe 39 in the radial direction of the first capture unit 40*a*. The protrusions 40*c* hinder travel of the particles P having tangential kinetic energy of the rotation of the rotational blades 37, which may result in further improvement of capture efficiency of the particles P bounced from the rotational blades 37. In addition, the protrusions 40*c* do not need to be stretched to the center of the exhaust pipe 39 and an amount of protrusion from the first capture unit 40*a* may be varied depending on a quantity of particles P generated and a rotational speed of the rotational blades 37.

Figure 7:
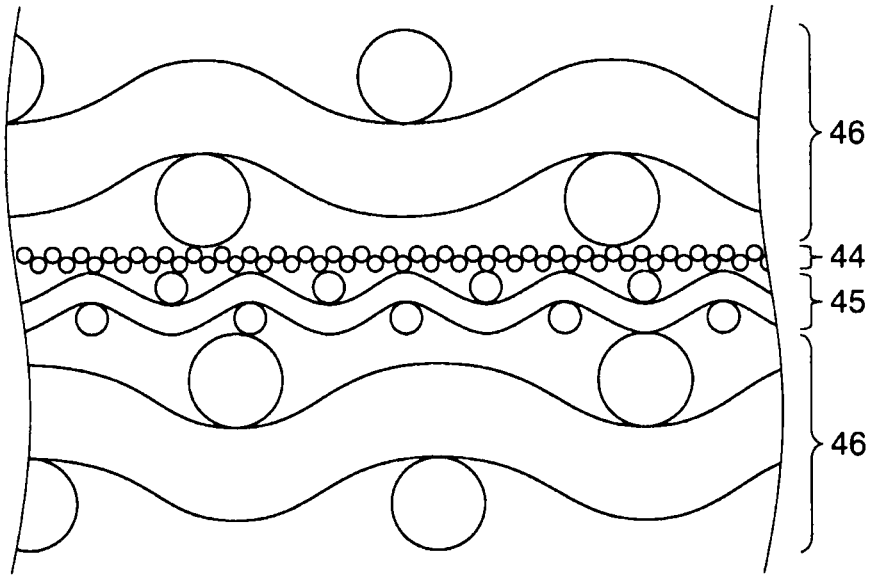
FIG. 7 is a schematic enlarged sectional view showing a structure of a modification of the mesh-like member.

The mesh-like member 43 does not necessarily have the third mesh-like layer 46 but may have at least the first mesh-like layer 44 and the second mesh-like layer 45 and the second mesh-like layer 45 may be exposed to the particle flying space. In addition, the number of layers forming the mesh-like member 43 is not limited to three. For example, as shown in FIG. 7, another third mesh-like layer 46 may be interposed between the second mesh-like layer 45 and the particle flying space. This can further improve rigidity of either the first capture unit 40*a* or the second capture unit 40*b*.

In addition, the first mesh-like layer 44 may be interposed between two second mesh-like layers 45, thereby allowing capture of particles flying from one direction or both directions. Even in this case, the third mesh-like layer 46 as a reinforcing material may be arranged in one side of a stack structure composed of the first mesh-like layer 44 and the two second mesh-like layers 45 or two third mesh-like layers 46 may be respectively arranged in both sides of the stack structure to interpose the stack structure therebetween.

In addition, the fiber-like materials forming the first to third mesh-like layers 44, 45 and 46 may be made of other sinterable metal than the above-mentioned stainless steel. Further, they may be made of ceramics such as alumina or the like.

The particle capture unit 40 including the mesh-like member 43 may be placed in any sites as long as they can be exposed to a flow of exhaust gas in components of the exhaust system, e.g., the manifold 14, the communication pipe 16 and the APC valve 17, or the TMP 18, as well as the exhaust pipe 39 in the substrate processing apparatus 10, and the shape and configuration of the particle capture unit may be changed depending on its arrangement site. Although this embodiment has been applied to an etching processing apparatus, this embodiment is not limited thereto but may be applied to other substrate processing apparatuses including a CVD apparatus, an ashing apparatus and or the like.

Figure 8:
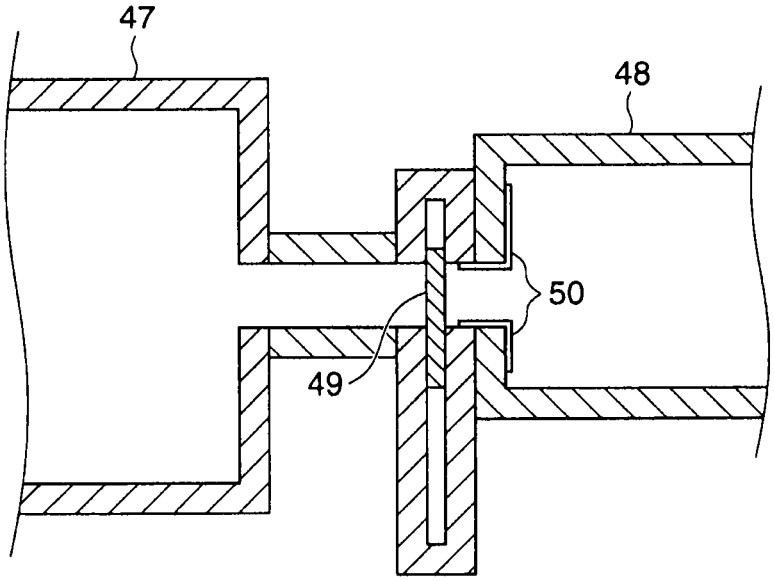
FIG. 8 is a schematic partial sectional view showing a modification of an apparatus to which the particle capture unit is applied.

In addition, the embodiments of the present invention may be applied to other apparatuses as long as they have sites where particles fly into a depressurizing space, as well as the substrate processing apparatus 10. For example, as shown in FIG. 8, a particle capture unit 50 may be arranged along an inner wall of a transfer chamber 48 near a gate valve 49 partitioning a processing chamber 47 of a substrate processing chamber and the transfer chamber 48.

While the invention has been shown and described with respect to the embodiments, it will be understood by those skilled in the art that various changes and modification may be made without departing from the scope of the invention as defined in the following claims.

What is claimed is:

1. A particle capture unit in a substrate processing apparatus, the particle capture unit comprising:

a sheet-shaped particle capturing multilayer structure including a first layer formed of a plurality of first fibers and a second layer formed of a multiplicity of second fibers, wherein the first fibers are thinner than the second fibers and an arrangement density of the first fibers in the first layer is higher than that of the second fibers in the second layer, wherein the substrate processing apparatus includes an exhaust system communicating with a pump having rotational blades, and wherein the exhaust system includes a gas-impermeable member having an inner peripheral surface, and further wherein a space is defined within the inner peripheral surface through which a particle-containing exhaust gas flows;

wherein the multilayer structure is configured to be disposed along the inner peripheral surface of the gas-impermeable member such that the second layer is interposed between the first layer and the space, and wherein the first layer and the second layer are hardened and bonded together by sintering.

2. The particle capture unit of claim 1, wherein a diameter of the first fibers ranges from 0.2 μm to 3 μm and a diameter of the second fibers ranges from 3 μm to 30 μm.

3. The particle capture unit of claim 1, wherein the multilayer structure further comprises a third layer formed of third fibers thicker than the second fibers, and the third layer is arranged opposite to the second layer via the first layer such that the first layer is between the second layer and the third layer.

4. The particle capture unit of claim 3, wherein a diameter of the third fibers ranges from 30 μm to 400 μm.

5. The particle capture unit of claim 3, wherein the multilayer structure further comprises a fourth layer formed of the third fibers and interposed between the second layer and the space.

6. The particle capture unit of claim 1, wherein the first fibers and second fibers are made of a stainless steel.

7. A method for manufacturing a particle capture unit and placing the particle capture unit in a substrate processing apparatus, wherein the substrate processing apparatus includes an exhaust system communicating with a pump having rotational blades, and wherein the exhaust system includes a gas-impermeable member having an inner peripheral surface, and wherein a space is defined within the inner peripheral surface through which a particle-containing exhaust gas flows;

the method comprising:

forming a first layer with a plurality of first fibers and a second layer with a multiplicity of second fibers;

overlapping and shaping the first layer and the second layer into a sheet-shaped particle capturing multilayer structure;

hardening and bonding the first layer and second layer together by sintering the multilayer structure; and placing the sintered multilayer structure in the substrate processing apparatus such that the sintered multilayer structure is positioned along the inner peripheral surface of the gas-impermeable member of the exhaust system communicating with the pump and such that the second layer is interposed between the first layer and the space, wherein the first fibers are thinner than the second fibers and wherein an arrangement density of the first fibers in the first layer is higher than that of the second fibers in the second layer.

8. A substrate processing apparatus comprising:

a processing chamber in which a substrate is processed;

an exhaust pump having rotational blades that are rotatable at a high speed, the exhaust pump serving to exhaust a particle-containing gas from the processing chamber;

an exhaust system which allows the processing chamber to communicate with the exhaust pump the exhaust system including an inner peripheral surface defining a space through which a particle-containing exhaust gas flows;

a particle capture unit exposed to the space in the exhaust system through which the particle-containing exhaust gas flows; and wherein the particle capture unit includes a particle capturing multilayer structure including a first layer formed of a plurality of first fibers and a second layer formed of a multiplicity of second fibers, wherein the first fibers are thinner than the second fibers and an arrangement density of the first fibers in the first layer is higher than that of the second fibers in the second layer, wherein the multilayer structure is disposed along the inner peripheral surface of at least a portion of the exhaust system such that the second layer is interposed between the first layer and the space, wherein the first layer and second layer are hardened and bonded together by sintering.

9. The substrate processing apparatus of claim 8, wherein the exhaust system includes an exhaust pipe, and the inner peripheral surface is an inner peripheral surface of the exhaust pipe, and wherein the particle capture unit further includes a plate-shaped part disposed in the exhaust pipe at an upstream side of the exhaust pump in an exhaust direction, the plate-shaped part being arranged on an axis of a rotational shaft of the rotational blades of the exhaust pump to cover the rotational shaft when viewed along the exhaust direction, and wherein the plate-shaped part has a multilayer structure the same as that of the multilayer structure disposed along the inner peripheral surface of the exhaust pipe.

10. The substrate processing apparatus of claim 9, wherein the particle capture unit further includes a plurality of protrusions protruding from the multilayer structure disposed along the inner peripheral surface of the exhaust pipe, wherein the plurality of protrusions protrude toward the inside of the exhaust pipe, and wherein the plurality of protrusions have a multilayer structure which is the same as that of the multilayer structure disposed along the inner peripheral surface of the exhaust pipe.

11. The substrate processing apparatus of claim 9, wherein the plate-shaped part is attached to a bar-shaped stay disposed to traverse the exhaust pipe.

12. The substrate processing apparatus of claim 9, wherein a free space is provided between the multilayer structure disposed along the inner peripheral surface and the plate-shaped part to thereby allow the gas to be freely exhausted through the free space without passing through the plate-shaped part or the multilayer structure disposed along the inner peripheral surface.

13. The particle capture unit of claim 1, wherein the second fibers of the second layer have a spacing therebetween that allows particles to pass through the second layer, and wherein the first fibers of the first layer have a spacing therebetween that causes the first layer to capture said particles.

14. The particle capture unit of claim 3, wherein the second fibers are thinner than the third fibers.

15. The substrate processing apparatus of claim 8, wherein the particle capture unit is configured to capture particles bouncing back towards the processing chamber after colliding with the rotational blades.

16. The substrate processing apparatus of claim 9, wherein the plate-shaped part is configured to capture particles flying toward the rotational blades.

17. The substrate processing apparatus of claim 8, wherein the second fibers of the second layer have a spacing therebetween that allows particles to pass through the second layer, and wherein the first fibers of the first layer have a spacing therebetween that causes the first layer to capture said particles.

* * * * *